US008668437B1

(12) United States Patent
Liang

(10) Patent No.: US 8,668,437 B1
(45) Date of Patent: Mar. 11, 2014

(54) TURBINE ENGINE COOLING FLUID FEED SYSTEM

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 1086 days.

(21) Appl. No.: 12/691,529

(22) Filed: Jan. 21, 2010

Related U.S. Application Data

(63) Continuation-in-part of application No. 11/526,255, filed on Sep. 22, 2006, now abandoned.

(51) Int. Cl.
*F01D 5/14* (2006.01)

(52) U.S. Cl.
USPC ..... 415/115; 415/116; 416/96 R

(58) Field of Classification Search
USPC ..... 416/96 R; 415/116
See application file for complete search history.

(56) References Cited

U.S. PATENT DOCUMENTS

| | | | | |
|---|---|---|---|---|
| 5,142,859 | A | 9/1992 | Glezer et al. | |
| 5,252,026 | A * | 10/1993 | Shepherd | 415/115 |
| 5,472,313 | A | 12/1995 | Quinones et al. | |
| 5,593,274 | A | 1/1997 | Carreno et al. | |
| 5,782,076 | A * | 7/1998 | Huber et al. | 60/782 |
| 6,019,573 | A | 2/2000 | Uematsu et al. | |
| 6,065,282 | A * | 5/2000 | Fukue et al. | 60/39.182 |
| 6,146,091 | A | 11/2000 | Watanabe et al. | |
| 6,231,303 | B1 * | 5/2001 | Tiemann et al. | 415/115 |
| 6,532,744 | B1 | 3/2003 | Reiter et al. | |
| 6,551,056 | B2 * | 4/2003 | Rau | 415/115 |
| 6,574,966 | B2 | 6/2003 | Hidaka et al. | |
| 6,612,114 | B1 * | 9/2003 | Klingels | 60/785 |
| 6,644,012 | B2 | 11/2003 | Hoffmann et al. | |
| 6,672,074 | B2 * | 1/2004 | Tiemann | 60/806 |
| 6,702,547 | B2 * | 3/2004 | Tiemann | 415/115 |
| 6,786,694 | B2 * | 9/2004 | Tiemann | 415/1 |
| 6,916,151 | B2 * | 7/2005 | Judet et al. | 415/115 |
| 6,969,233 | B2 | 11/2005 | Powis et al. | |
| 6,981,841 | B2 * | 1/2006 | Krammer et al. | 415/115 |
| 7,131,813 | B2 * | 11/2006 | Tiemann | 415/115 |
| 7,192,245 | B2 * | 3/2007 | Djeridane et al. | 415/115 |
| 2002/0150470 | A1 * | 10/2002 | Tiemann | 415/115 |
| 2002/0172591 | A1 * | 11/2002 | Glynn et al. | 415/115 |
| 2003/0035717 | A1 * | 2/2003 | Tiemann | 415/115 |
| 2005/0111964 | A1 * | 5/2005 | Krammer et al. | 415/115 |
| 2005/0201857 | A1 * | 9/2005 | Ferra et al. | 415/115 |
| 2008/0112793 | A1 * | 5/2008 | Lee et al. | 415/115 |
| 2008/0112794 | A1 * | 5/2008 | Lee et al. | 415/115 |

FOREIGN PATENT DOCUMENTS

| | | | | |
|---|---|---|---|---|
| EP | 0753704 | | 1/1997 | |
| EP | 0806544 | | 11/1997 | |
| EP | 0909878 | | 4/1999 | |
| EP | 1306521 | | 5/2003 | |
| EP | 1306521 | A1 * | 5/2003 | F01D 5/08 |
| EP | 1428984 | | 6/2004 | |

* cited by examiner

*Primary Examiner* — Edward Look
*Assistant Examiner* — Aaron R Eastman

(57) ABSTRACT

A cooling fluid feed system for a turbine engine for directing cooling fluids from a compressor, through one or more impellers, and into row one turbine vanes and one or more rows of turbine blades for increasing the cooling capacity of the turbine vanes and blades. Such a configuration increases cooling capacity, which in turn increases the capacity for growth within the turbine engine, creates a larger cooling fluid to gas side pressure differential and reduces amount of bleed off of cooling fluids from the compressor, thereby increasing efficiency of the turbine engine.

20 Claims, 4 Drawing Sheets

TURBINE ENGINE COOLING FLUID FEED SYSTEM

CROSS-REFERENCE TO RELATED APPLICATION

This patent application is a continuation-in-part application of U.S. patent application Ser. No. 11/526,255, filed Sep. 22, 2006, which is incorporated by reference in its entirety.

FIELD OF THE INVENTION

This invention is directed generally to turbine engines, and more particularly to cooling fluid feed systems in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades and turbine vanes must be made of materials capable of withstanding such high temperatures. Turbine blades, vanes and other components often contain cooling systems for prolonging the life of these items and reducing the likelihood of failure as a result of excessive temperatures.

Typically, turbine vanes extend radially inward from a vane carrier and terminate within close proximity of a rotor assembly. The turbine vanes typically include a plurality of cooling channels positioned in internal aspects of the turbine vanes. A controlling factor in the design of the internal cooling channels is the pressure differential between the internal cooling channels and the outer combustor gases. Often, the pressure differential is too small to enable film cooling orifices to be used effectively. As a result, the capacity to cool the turbine vanes is limited and thus, the operating range and potential growth of the turbine engine are thereby limited as well. Thus, a need exists for a more efficient cooling fluid feed system design for row one turbine vanes to provide pressurized cooling fluids to enable turbine engine growth and increased operating range.

SUMMARY OF THE INVENTION

This invention relates to a cooling fluid feed system for a turbine engine for supplying cooling fluids to row one turbine vanes and supplying cooling fluids to a first turbine blade row or a second turbine blade row, or both. The cooling fluid feed system may include a first row turbine vane impeller for increasing the pressure of cooling fluids supplied to the row one turbine vanes. The cooling fluid feed system may also include a turbine blade impeller for increasing the pressure of cooling fluids supplied to the first or second rows of turbine blades, or both. Increasing the pressure of the cooling fluids supplied to the row one turbine vanes may reduce the operating temperature of the vanes by enabling turbine vane cooling systems to use more efficient cooling channel designs, such as by incorporating film cooling holes within internal cooling channels. The cooling fluids may be, but are not limited to, cooling air.

The turbine engine may include one or more combustors positioned upstream from a rotor assembly. The rotor assembly may include one or more rows of turbine blades. In one embodiment, first and second rows of turbine blades may extend radially outward from a rotor. The turbine engine may also include a compressor positioned upstream from the combustor. A first row of turbine vanes may be attached to a vane carrier. The turbine vanes may extend radially inward and may terminate proximate to the rotor assembly upstream of the first row of turbine blades. A first row turbine vane impeller may be in fluid communication with cooling systems positioned internally within the turbine vanes in the first row of turbine vanes for increasing the pressure of cooling fluids flowing from the compressor. The first row turbine vane impeller may have a cross-sectional area that increases moving radially outward. One or more concentric bores may extend from the compressor to the first row turbine vane impeller to direct cooling fluids from the compressor to the first row turbine vane impeller. The first row turbine vane impeller may be formed from a plurality of radially extending channels positioned in close proximity to a first blade rotor. A plurality of turning guide vanes may be positioned radially inward from the first row turbine vane impeller to direct cooling fluids from the concentric bore into the first row turbine vane impeller.

The turbine engine may also include a turbine blade impeller positioned between first and second blade rotors that are attached to and support the first and second rows of turbine blades. The turbine blade impeller may be attached to at least one of the first and second blade rotors with a circumferential slot radially inward from the turbine blade impeller. The turbine blade impeller may be formed from a plurality of radially extending channels. The turbine engine may include a first cooling fluid hole in fluid communication with the first row of turbine blades and a second cooling fluid hole in fluid communication with the second row of turbine blades. A mid-stage bleed fluid channel may be in fluid communication with a mid-stage bleed fluid supply and the turbine blade impeller. A plurality of turning guide vanes may be positioned in the mid-stage fluid channel to direct cooling fluids from the mid-stage bleed fluid channel to the turbine blade impeller.

During use, cooling fluids, such as, but not limited to, air, may flow from the compressor, through the concentric bore, through the turning guide vanes and into the first row turbine vane impeller. The cooling fluids may be pumped radially outward within the first row turbine vane impeller to the vane cooling fluid manifold. The vane cooling fluid manifold may function as a diffuser plenum to create the maximum dynamic pressure head and to create the maximum relative velocity head of the cooling fluids. The higher the pressure head, the greater the potential for the cooling fluids to adequately cool the row one turbine vanes. The cooling fluids may flow from the vane cooling fluid manifold to the turbine vane cooling systems of the row one turbine vanes. Thus, the cooling fluids used to cool the row one turbine vanes flow radially outward through the turbine vanes.

Cooling fluids may also flow through the mid-stage bleed fluid channel, through the turning guide vanes and into the turbine blade impeller. The cooling fluids may be pressurized in the impeller and may be discharged through the first and second cooling fluid holes and into the first and second turbine blade rows, respectively.

An advantage of this invention is that the row one turbine vane impeller increases the cooling fluid to gas side pressure differential such that a more effective cooling scheme may be used in the cooling system positioned internally within the turbine vanes. In particular, there may be a pressure differential developed that is sufficient to use both leading edge film cooling holes together with film cooling holes in other locations. Use of such effective cooling techniques enables a higher firing temperature to be used in the combustor, thereby resulting in greater turbine engine output and creating the possibility of turbine engine growth.

Another advantage of this invention is that the combustor may be operated at a decreased pressure drop across the combustor, thereby resulting in higher turbine inlet operating pressure, overall higher working pressure ratio across the turbine and higher engine power output.

Yet another advantage of this invention is that use of mid-stage bleed air for turbine cooling reduces the cooling fluid bleed off at higher compressor stages.

Thus, less work is required to be conducted on the input air, which equates to higher turbine cycle efficiency.

Another advantage of this invention is that use of mid-stage bleed air for turbine cooling reduces the cooling fluid bleed off at higher compressor stages, thereby resulting in more working fluid flowing through the combustor, resulting in a higher power output.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
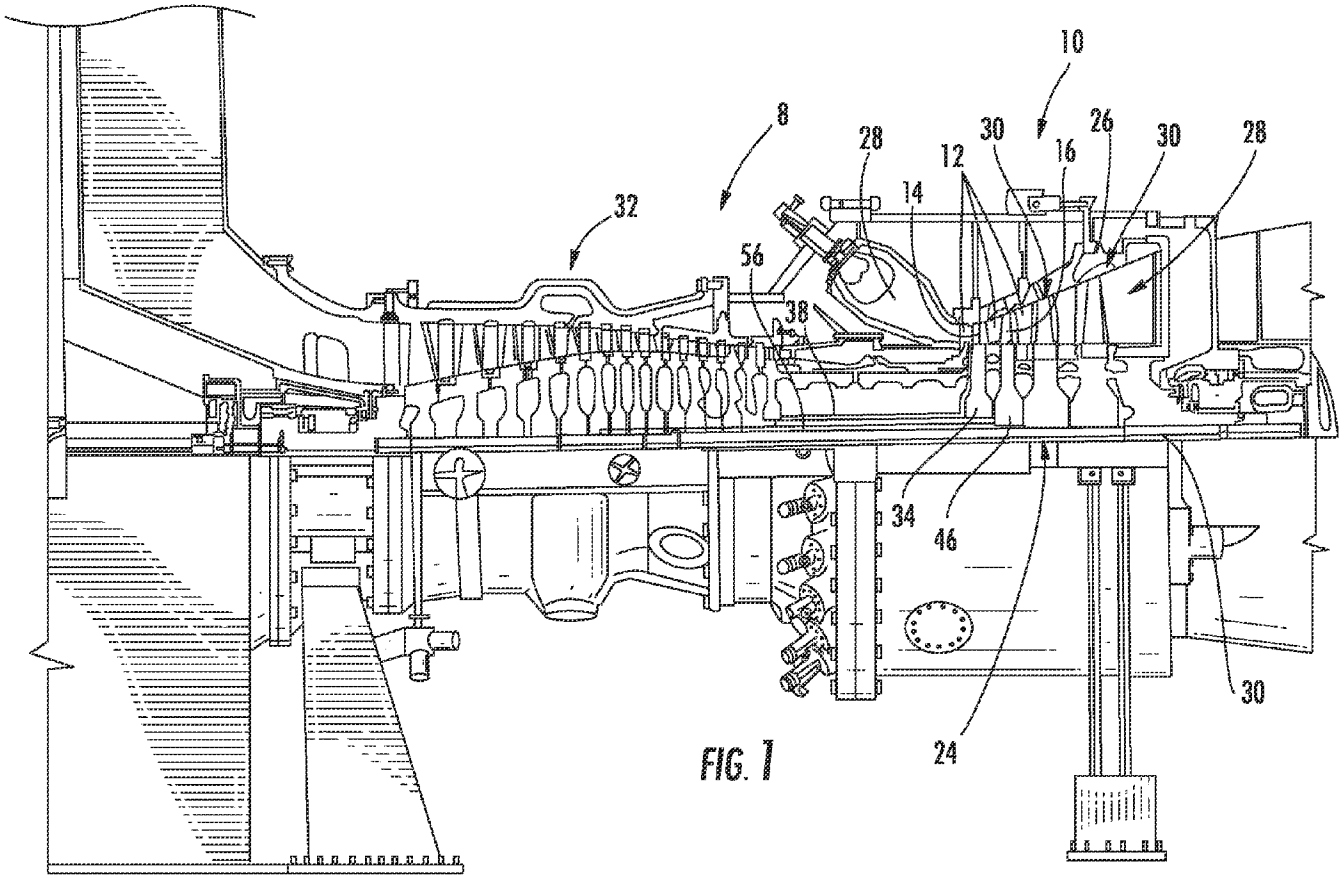
FIG. 1 is a cross-sectional side view of a portion of a turbine engine including a cooling fluid feed system of this invention.
Figure 2:
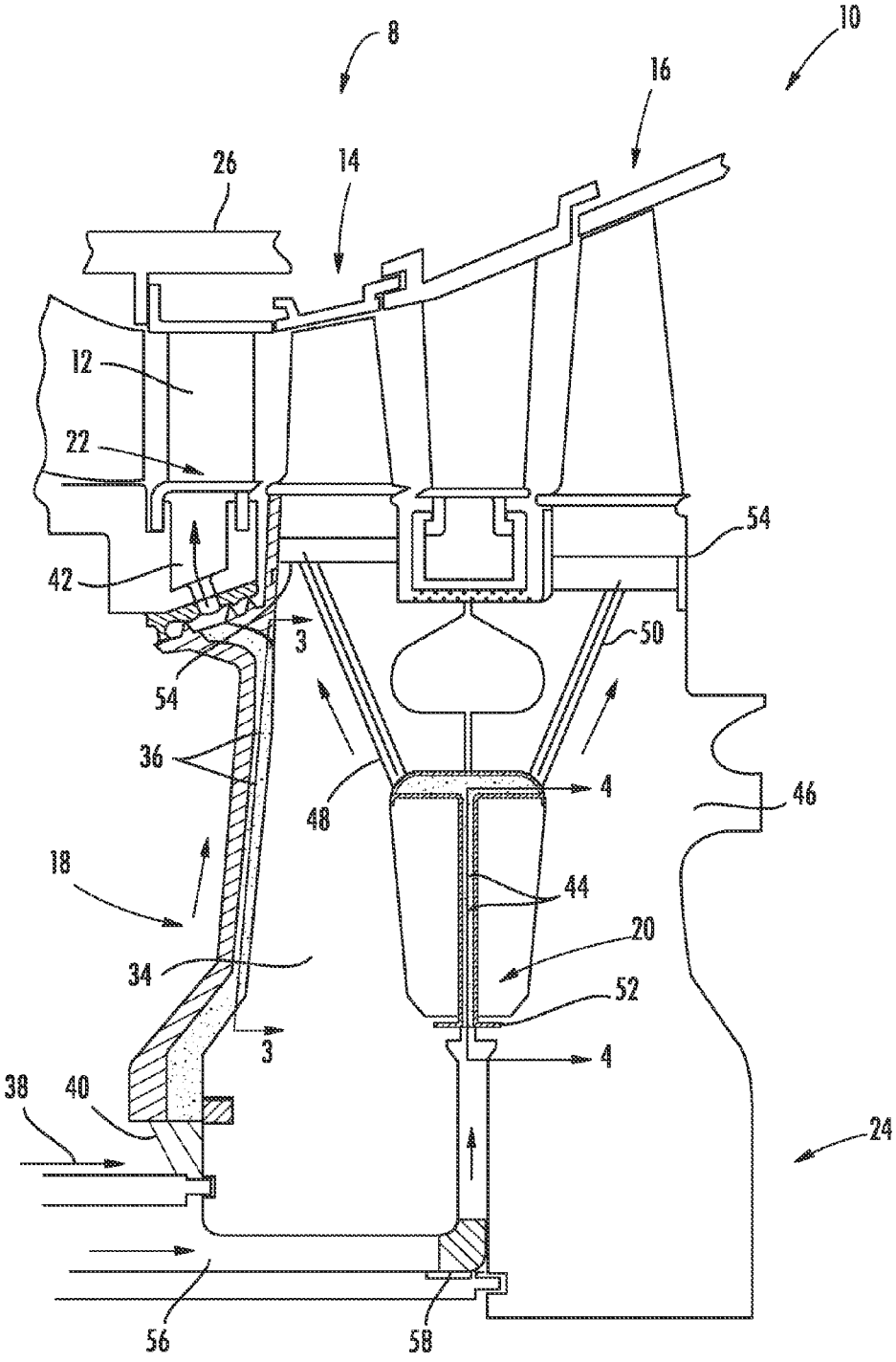
FIG. 2 is a detailed view of a portion of the turbine engine shown in FIG. 1 at line 2-2.

As shown in FIGS. 1-4, this invention is directed to a cooling fluid feed system 10 for a turbine engine 8 for supplying cooling fluids to row one turbine vanes 12 and supplying cooling fluids to a first turbine blade row 14 or a second turbine blade row 16, or both. The cooling fluid feed system 10 may include a first row turbine vane impeller 18 for increasing the pressure of cooling fluids supplied to the row one turbine vanes 12 so that more efficient cooling schemes may be used in the turbine vanes 12. The cooling fluid feed system 10 may also include a turbine blade impeller 20 for increasing the pressure of cooling fluids supplied to the first or second rows of turbine blades 14, 16, or both. Increasing the pressure of the cooling fluids supplied to the row one turbine vanes 12 may reduce the operating temperature of the vanes 12 by enabling turbine vane cooling systems 22 to better incorporate film cooling holes with internal cooling channels. The cooling fluids may be, but are not limited to, cooling air.

As shown in FIG. 1, the turbine engine 8 may include a rotor assembly 24 positioned radially inward from a vane carrier 26 and the turbine vanes 12. The rotor assembly 24 may include first and second rows of turbine blades 14, 16, or more, extending radially outward from the rotor assembly 24. As shown in FIG. 1, the turbine blades 14, 16 may be assembled into rows, which are also referred to as stages. The turbine engine 8 may also include one or more combustors 28 positioned upstream from the rotor assembly 24. The rotor assembly 24 may be configured to enable the rotor 30 to rotate relative to the vane carrier 26 and turbine vanes 12. The turbine engine 8 may also include a compressor 32 positioned upstream from the combustor 28.

Figure 3:
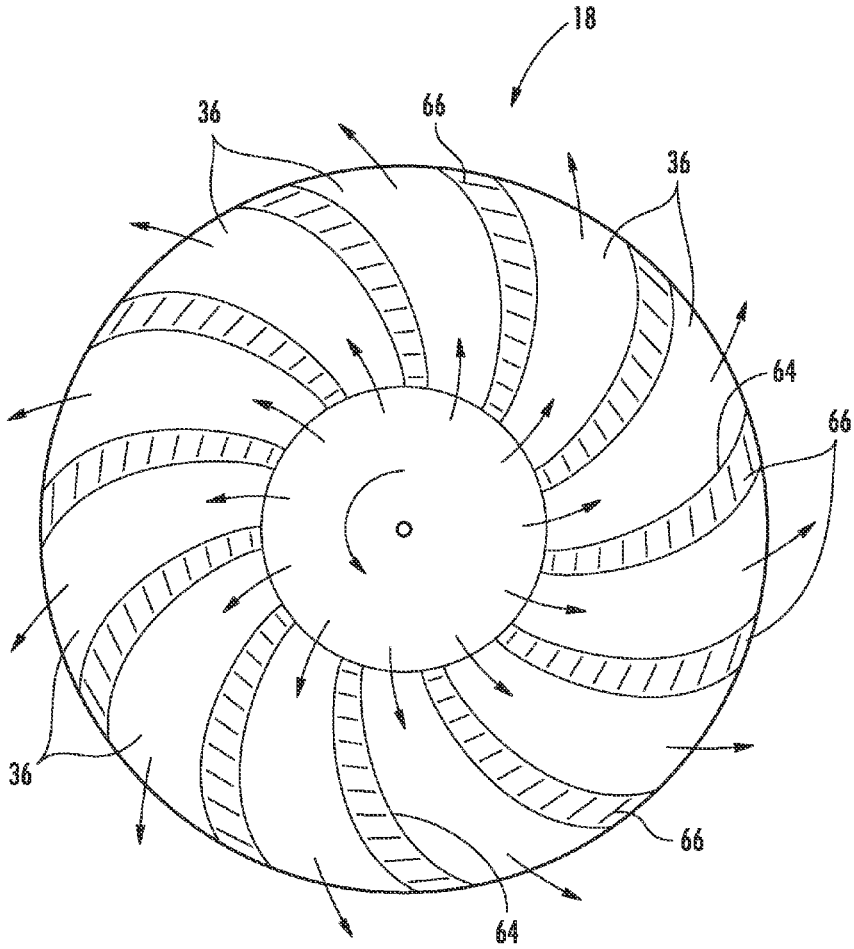
FIG. 3 is an axial, cross-sectional view of a turbine blade impeller taken at section lines 3-3 in FIG. 2.

The cooling fluid feed system 10 may include a first row turbine vane impeller 18 positioned proximate to a first blade rotor 34. The turbine vane impeller 18 may be a centrifugal stage impeller that may induce a solid body rotating pumping effect that may raise the cooling fluid pressure for cooling fluids supplied to the row one turbine vanes 12. In at least one embodiment, as shown in FIG. 3, the first row turbine vane impeller 18 may be formed from a plurality of radially extending channels 36 creating a pumping action due to solid body rotation principal. The radially extending channels 36 may be formed from curved channels 36 whose cross-sectional areas increase moving radially outward. The curved channels 36 may be curved away from the direction of rotation and curved generally in a plane orthogonal to a rotational axis of the rotor assembly 24. In particular, as shown in FIG. 3, a leading edge 64 of the curved channels 36 may be generally concave. The curved channels 36 may be defined by curved ribs 66. The curved ribs 66 may have cross-sectional areas that increase, decrease or remain unchanged moving radially outward.

The first row turbine vane impeller 18 may receive cooling fluids from the compressor 32 as compressor exhaust through one or more concentric bores 38. The concentric bore 38 may be any appropriate size. One or more turning guide vanes 40 may be positioned to direct cooling fluids from the concentric bore 38 to the first row turbine vane impeller 18. One or more vane cooling fluid manifolds 42 may be positioned between the row one turbine vanes 12 and the first row turbine vane impeller 18 for collecting cooling fluids flowing from the first row turbine vane impeller 18.

The cooling fluid feed system 10 may also include a turbine blade impeller 20 for pressurizing cooling fluids being sent to the first or second turbine blade rows 14, 16 or both. The turbine blade impeller 20 may be formed from a plurality of radially extending channels 44 positioned between the first blade rotor 34 and a second blade rotor 46. The first and second blade rotors, 34, 46 are attached to and support the first and second rows of turbine blades 14, 16, respectively. The cooling fluid feed system 10 may also include one or more first cooling fluid holes 48 in fluid communication with the first row of turbine blades 14 and one or more second cooling fluid holes 50 in fluid communication with the second row of turbine blades 16. Each turbine blade 14, 16 may include a hole 48, 50, respectively. The rotor assemblies 24 may have different configurations and may include a variety of numbers of turbine blades, such as for example and not by way of limitation, sixteen or thirty two blades. Each blade may be supplied with a single cooling hole, 48 or 50 in communication with the turbine blade impeller 20.

Figure 4:
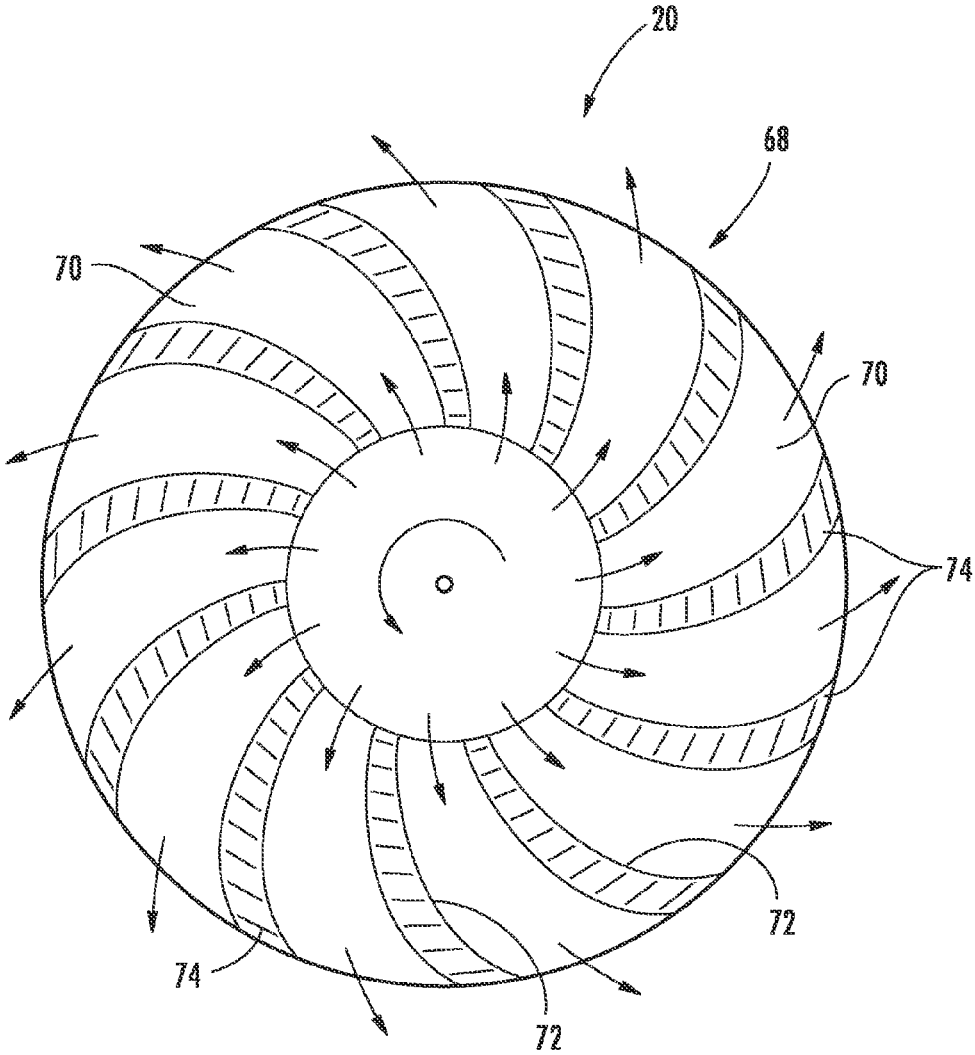
FIG. 4 is an axial, cross-sectional view of a turbine blade impeller taken at section lines 4-4 in FIG. 2.

The turbine blade impeller 20 may be attached to the first and second blade rotors 34, 36 through one or more circumferential slots 52 positioned radially inward from turbine blade impeller 20. The turbine blade impeller 20 may also be attached radially outward of the impeller at the rim 54 with an interference fit, such as a snap fit. In at least one embodiment, as shown in FIG. 4, the turbine blade impeller 20 may be formed from a plurality of radially extending channels 68 creating a pumping action due to solid body rotation principal. The radially extending channels 68 may be formed from curved channels 70 whose cross-sectional areas increase moving radially outward. The curved channels 70 may be curved away from the direction of rotation. In particular, as shown in FIG. 4, a leading edge 72 of the curved channels 70 may be generally concave. The curved channels 70 may be curved away from the direction of rotation and curved generally in a plane orthogonal to a rotational axis of the rotor assembly 24. The curved channels 70 may be defined by curved ribs 74. The curved ribs 74 may have cross-sectional areas that increase, decrease or remain unchanged moving radially outward.

The cooling fluid feed system 10 may include a mid-stage bleed fluid channel 56 in fluid communication with a mid-stage bleed fluid supply and the turbine blade impeller 20. The mid-stage fluid channel 56 may have any appropriate configuration.

One or more turning guide vanes 58 may be positioned to direct cooling fluids from the mid-stage bleed fluid channel 56 to the turbine blade impeller 20 through the channel formed between the first and second blade rotors 34, 46. The turning guide vanes 58 may be mounted on a bore of the second blade rotor 46.

During use, cooling fluids, such as, but not limited to, air, may flow from the compressor 32, through the concentric bore 38, through the turning guide vanes 40 and into the first row turbine vane impeller 18. The cooling fluids may be pumped radially outward within the first row turbine vane impeller 18 to the vane cooling fluid manifold 42. The radially extending channels 36 increase the pressure of cooling fluids out of the first row turbine vane impeller 18. The vane cooling fluid manifold 42 may function as a diffuser plenum to create the maximum pressure head and to create a relative velocity head of the cooling fluids. The higher the pressure head, the greater the potential for the cooling fluids to adequately cool the row one turbine vanes 12. The cooling fluids may flow from the vane cooling fluid manifold 42 to the turbine vane cooling systems 22 of the row one turbine vanes 12. Thus, the cooling fluids used to cool the row one turbine vanes 12 flow radially outward through the turbine vanes 12.

Cooling fluids may also flow through the mid-stage bleed fluid channel 56, through the turning guide vanes 58 and into the turbine blade impeller 20. The cooling fluids may be pressurized in the impeller 20 in the curved channels 70 and may be discharged through the first and second cooling fluid holes 48, 50 and into the first and second turbine blade rows 14, 16, respectively.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine engine, comprising:

at least one combustor positioned upstream from a rotor assembly, wherein the rotor assembly includes at least first and second rows of turbine blades extending radially outward from a rotor;

a compressor positioned upstream from the at least one combustor;

a first row of turbine vanes attached to a vane carrier, wherein the turbine vanes each extend radially inward and terminate proximate to the rotor assembly upstream of the first row of turbine blades;

a first row turbine vane impeller in fluid communication with cooling systems positioned internally within the turbine vanes in the first row of turbine vanes for increasing the pressure of cooling fluids flowing from the compressor, wherein the first row turbine vane impeller is formed from a plurality of radially extending curved channels that are each formed by radially extending, curved ribs; and a concentric bore extending from the compressor to the first row turbine vane impeller to direct cooling fluids from the compressor to the first row turbine vane impeller.

2. The turbine engine of claim 1, wherein the first row turbine vane impeller is formed from a plurality of radially extending channels positioned in close proximity to a first blade rotor.

3. The turbine engine of claim 1, further comprising a plurality of turning guide vanes positioned radially inward from the first row turbine vane impeller to direct cooling fluids from the concentric bore into the first row turbine vane impeller.

4. The turbine engine of claim 1, further comprising a turbine blade impeller positioned between first and second blade rotors that are attached to the first and second rows of turbine blades and comprising a first cooling fluid hole in fluid communication with the first row of turbine blades and a second cooling fluid hole in fluid communication with the second row of turbine blades.

5. The turbine engine of claim 4, wherein the turbine blade impeller is attached to at least one of the first and second blade rotors with a circumferential slot positioned radially inward from the turbine blade impeller.

6. The turbine engine of claim 5, wherein the turbine blade impeller is formed from a plurality of curved radially extending channels having increasing cross-sectional areas moving radially outward, wherein the curved radially extending channels are each formed by radially extending, curved ribs.

7. The turbine engine of claim 4, further comprising a mid-stage bleed fluid channel in fluid communication with the turbine blade impeller.

8. The turbine engine of claim 7, further comprising a plurality of turning guide vanes in the mid-stage fluid channel to direct cooling fluids from the mid-stage bleed fluid channel to the turbine blade impeller.

9. A turbine engine, comprising:

at least one combustor positioned upstream from a rotor assembly, wherein the rotor assembly includes at least first and second rows of turbine blades extending radially outward from a rotor;

a compressor positioned upstream from the at least one combustor;

a first row of turbine vanes attached to a vane carrier, wherein the turbine vanes each extend radially inward and terminate proximate to the rotor assembly upstream of the first row of turbine blades;

a turbine blade impeller positioned between first and second blade rotors that are attached to the first and second rows of turbine blades and comprising a first cooling fluid hole in fluid communication with the first row of turbine blades and a second cooling fluid hole in fluid communication with the second row of turbine blades, wherein the turbine vane impeller is formed from a plurality of radially extending curved channels that are each formed by radially extending, curved ribs; and a mid-stage bleed fluid channel in fluid communication with the turbine blade impeller.

10. The turbine engine of claim 9, wherein the turbine blade impeller is attached to at least one of the first and second blade rotors with a circumferential slot positioned radially inward from the turbine blade impeller.

11. The turbine engine of claim 9, wherein the turbine blade impeller is formed from a plurality of curved radially extending channels having cross-sectional areas that increase moving radially outward.

12. The turbine engine of claim 9, further comprising a plurality of turning guide vanes in the mid-stage fluid channel to direct cooling fluids from the mid-stage bleed fluid channel to the turbine blade impeller.

13. The turbine engine of claim 9, further comprising a first row turbine vane impeller in fluid communication with cooling systems positioned internally within the turbine vanes in the first row of turbine vanes for increasing the pressure of cooling fluids flowing from the compressor and a concentric bore extending from the compressor to the first row turbine vane impeller to direct cooling fluids from the compressor to the first row turbine vane impeller.

14. The turbine engine of claim 13, wherein the first row turbine vane impeller is formed from a plurality of radially extending channels positioned in close proximity to a first blade rotor and having cross-sectional areas that increase moving radially outward.

15. The turbine engine of claim 13, further comprising a plurality of turning guide vanes positioned radially outward from the first row turbine vane impeller to direct cooling fluids from the first row turbine vane impeller into the cooling systems in the turbine vanes in the first row of turbine vanes.

16. A turbine engine, comprising:

at least one combustor positioned upstream from a rotor assembly, wherein the rotor assembly includes at least first and second rows of turbine blades extending radially outward from a rotor;

a compressor positioned upstream from the at least one combustor;

a first row of turbine vanes attached to a vane carrier, wherein the turbine vanes each extend radially inward and terminate proximate to the rotor assembly upstream of the first row of turbine blades;

a first row turbine vane impeller in fluid communication with cooling systems positioned internally within the turbine vanes in the first row of turbine vanes for increasing the pressure of cooling fluids flowing from the compressor, wherein the first row turbine vane impeller is formed from a plurality of radially extending curved channels, wherein the curved radially extending channels are each formed by radially extending, curved ribs;

a concentric bore extending from the compressor to the first row turbine vane impeller to direct cooling fluids from the compressor to the first row turbine vane impeller;

a turbine blade impeller positioned between first and second blade rotors that are attached to the first and second rows of turbine blades, wherein the turbine blade impeller is formed from a plurality of radially extending curved channels, wherein the curved radially extending channels are each formed by radially extending, curved ribs;

a first cooling fluid hole in fluid communication with the first row of turbine blades;

a second cooling fluid hole in fluid communication with the second row of turbine blades; and a mid-stage bleed fluid channel in fluid communication with a mid-stage bleed fluid supply and the turbine blade impeller.

17. The turbine engine of claim 16, wherein the first row turbine vane impeller is formed from a plurality of radially extending curved channels having a cross-sectional area that increases moving radially outward and positioned in close proximity to a first blade rotor.

18. The turbine engine of claim 16, further comprising a plurality of turning guide vanes positioned radially inward from the first row turbine vane impeller to direct cooling fluids from the first row turbine vane impeller into the cooling systems in the turbine vanes in the first row of turbine vanes and further comprising a plurality of turning guide vanes to direct cooling fluids from the mid-stage bleed fluid channel to the turbine blade impeller.

19. The turbine engine of claim 16, wherein the turbine blade impeller is attached to at least one of the first and second blade rotors with a circumferential slot positioned radially inward from the turbine blade impeller.

20. The turbine engine of claim 16, wherein the turbine blade impeller is formed from a plurality of curved radially extending channels having a cross-sectional area that increases moving radially outward that are each formed by radially extending, curved ribs.

* * * * *